US008185024B2

(12) United States Patent
Sakoh et al.

(10) Patent No.: US 8,185,024 B2
(45) Date of Patent: May 22, 2012

(54) DEVELOPING UNIT HAVING A MAGNET MEMBER AND IMAGE FORMING APPARATUS INCLUDING THE DEVELOPING UNIT

(75) Inventors: Kiyoshi Sakoh, Saitama (JP); Kiyoshi Nagamine, Saitama (JP); Tomoyuki Yoshii, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 275 days.

(21) Appl. No.: 12/615,538

(22) Filed: Nov. 10, 2009

(65) Prior Publication Data

US 2010/0247151 A1 Sep. 30, 2010

(30) Foreign Application Priority Data

Mar. 27, 2009 (JP) ..... 2009-080013

(51) Int. Cl.
*G03G 15/08* (2006.01)

(52) U.S. Cl. ..... 399/274

(58) Field of Classification Search ..... 399/254, 399/256, 274, 275, 277, 284
See application file for complete search history.

(56) References Cited

U.S. PATENT DOCUMENTS

| | | | | |
|---|---|---|---|---|
| 6,067,433 | A * | 5/2000 | Kimura et al. | 399/274 |
| 6,978,109 | B2 * | 12/2005 | Shoji et al. | 399/274 |
| 7,899,373 | B2 * | 3/2011 | Yamagishi et al. | 399/275 |
| 2003/0054275 | A1 * | 3/2003 | Sugimoto et al. | 430/106.1 |
| 2009/0047041 | A1 | 2/2009 | Kubo et al. | |
| 2009/0214266 | A1 * | 8/2009 | Kato et al. | 399/254 |
| 2010/0054815 | A1 * | 3/2010 | Okimura et al. | 399/254 |

FOREIGN PATENT DOCUMENTS

| | | | |
|---|---|---|---|
| JP | 03-102377 | A | 4/1991 |
| JP | 10171242 | A * | 6/1998 |
| JP | 2000293035 | A * | 10/2000 |
| JP | 2003167426 | A * | 6/2003 |
| JP | 2005077538 | A * | 3/2005 |
| JP | 2005-157213 | A | 6/2005 |
| JP | 2005-250369 | A | 9/2005 |
| JP | 2007-086620 | A | 4/2007 |
| JP | 2007-333898 | A | 12/2007 |
| JP | 2009-047845 | A | 3/2009 |
| JP | 2009-053362 | A | 3/2009 |

OTHER PUBLICATIONS

Notification of Reasons for Refusal issued Jan. 25, 2011 in counterpart Japanese Application No. 2009-080013.

* cited by examiner

*Primary Examiner* — Robert Beatty
(74) *Attorney, Agent, or Firm* — Sughrue Mion, PLLC

(57) ABSTRACT

A developing unit including a retainer receiving portion for receiving a developer retainer, a first agitation portion adjacent to the retainer receiving portion, a second agitation portion adjacent to the first agitation portion, a first conveyance member received in the first agitation portion and conveying a developer in the first agitation portion in a first conveyance direction, a second conveyance member received in the second agitation portion and conveying a developer in the second agitation portion in a second conveyance direction reverse to the first conveyance direction, and a magnetic member disposed between the second conveyance member and the developer retainer and having magnetism.

9 Claims, 6 Drawing Sheets

DEVELOPING UNIT HAVING A MAGNET MEMBER AND IMAGE FORMING APPARATUS INCLUDING THE DEVELOPING UNIT

CROSS-REFERENCE TO RELATED APPLICATIONS

This application is based on and claims priority under 35 USC 119 from Japanese Patent Application No. 2009-080013 filed on Mar. 27, 2009.

BACKGROUND

Technical Field

The present invention relates to a developing unit and an image forming apparatus.

SUMMARY

[1] According to an aspect of the invention, a developing unit includes a developer retainer, a developing vessel, a first conveyance member, a second conveyance member and a magnetic member. The developer retainer includes a magnet member and a retaining member. The magnet member has magnetic poles. The retaining member is provided on an outer circumference of the magnet member and retains a developer having magnetism to be sucked on a surface of the retaining member by a magnetic force of the magnet member. The developing vessel receives the developer internally, and includes a retainer receiving portion, a first agitation portion and a second agitation portion. The retainer receiving portion receives the developer retainer. The first agitation portion is adjacent to the retainer receiving portion. The second agitation portion is adjacent to the first agitation portion. The first conveyance member is received in the first agitation portion and conveys the developer in the first agitation portion in a first conveyance direction. The second conveyance member is received in the second agitation portion and conveys the developer in the second agitation portion in a second conveyance direction which is reverse to the first conveyance direction. The magnetic member is disposed between the second conveyance member and the developer retainer and which has magnetism.

BRIEF DESCRIPTION OF THE DRAWINGS

Exemplary embodiments of the invention will be described in detail based on the following figures, wherein.

DETAILED DESCRIPTION

Figure 1:
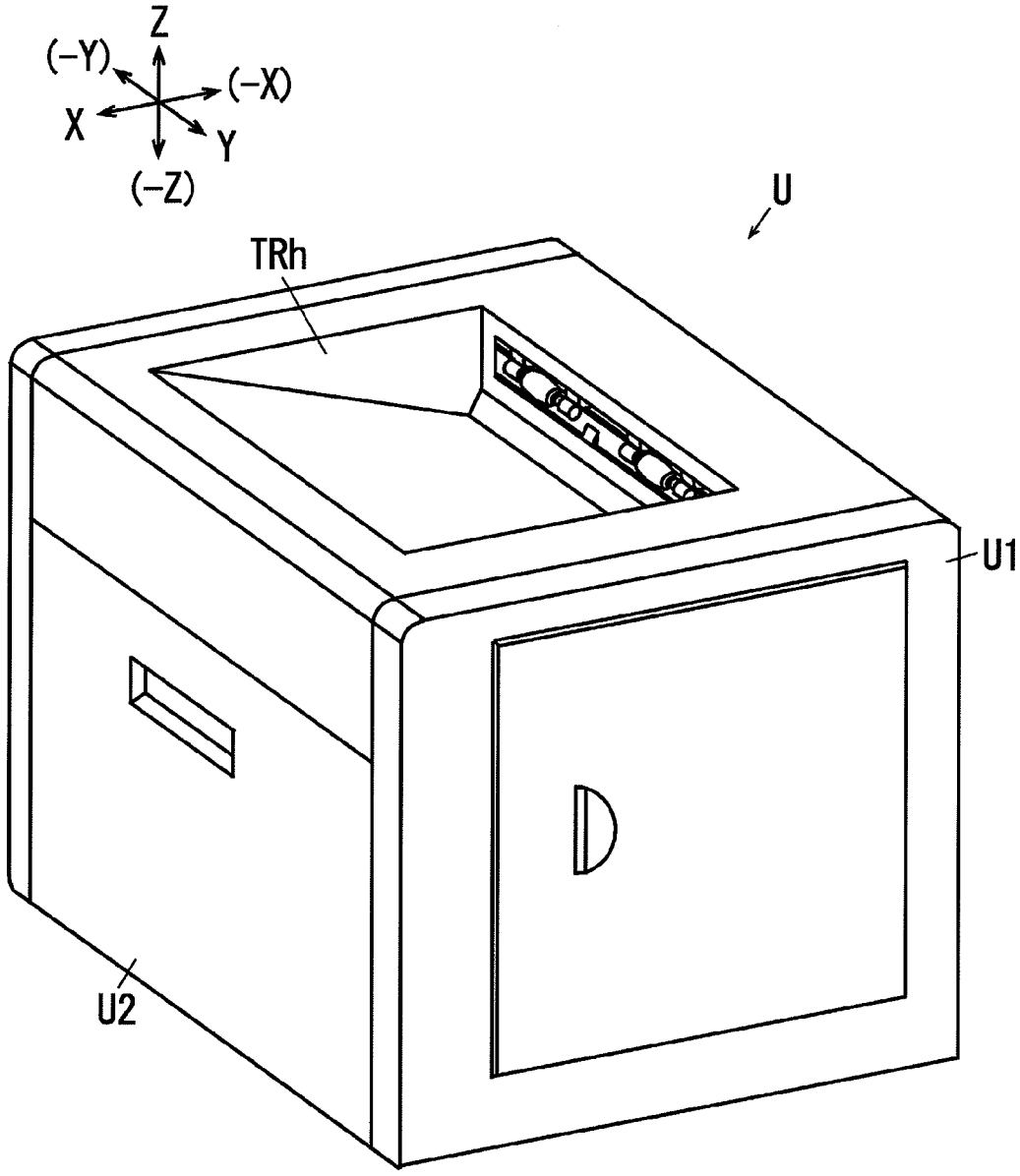
FIG. 1 is an overall perspective view of a printer according to a first embodiment of the invention.

Although specific examples of modes for carrying out the invention (hereinafter referred to as "embodiments") will be described below with reference to the drawings, the invention is not limited to the following embodiments.

In order to facilitate understanding of the following description, in the drawings, the front/rear direction is indicated as an X-axis direction, the left/right direction is indicated as a Y-axis direction and the up/down direction is indicated as a Z-axis direction, and directions or sides designated by the arrows X, −X, Y, −Y, Z and −Z are indicated as the front direction, the rear direction, the right direction, the left direction, the upper direction and the lower direction, or the front side, the rear side, the right side, the left side, the upper side and the lower side respectively.

In the drawings, each arrow with "•" written in "○" means an arrow directed from the back side of the sheet to the front side thereof and each arrow with "x" written in "○" means an arrow directed from the front side of the sheet to the back side thereof.

In the following description using the drawings, any other member than members required for description is omitted from the drawings suitably for the purpose of facilitating understanding.

FIG. 1 is an overall perspective view of a printer according to a first embodiment of the invention.

In FIG. 1, a printer U as an image forming apparatus according to the first embodiment of the invention has an image forming apparatus body U1. A front cover U2 is supported in the front surface of the image forming apparatus body U1 so as to be openable around the lower end of the front cover U2. The front cover U2 is an example of an openable member, which is opened and closed for supplying new media. A discharge tray TRh which is an example of a paper discharge portion is provided on the top of the image forming apparatus body U1.

Figure 2:
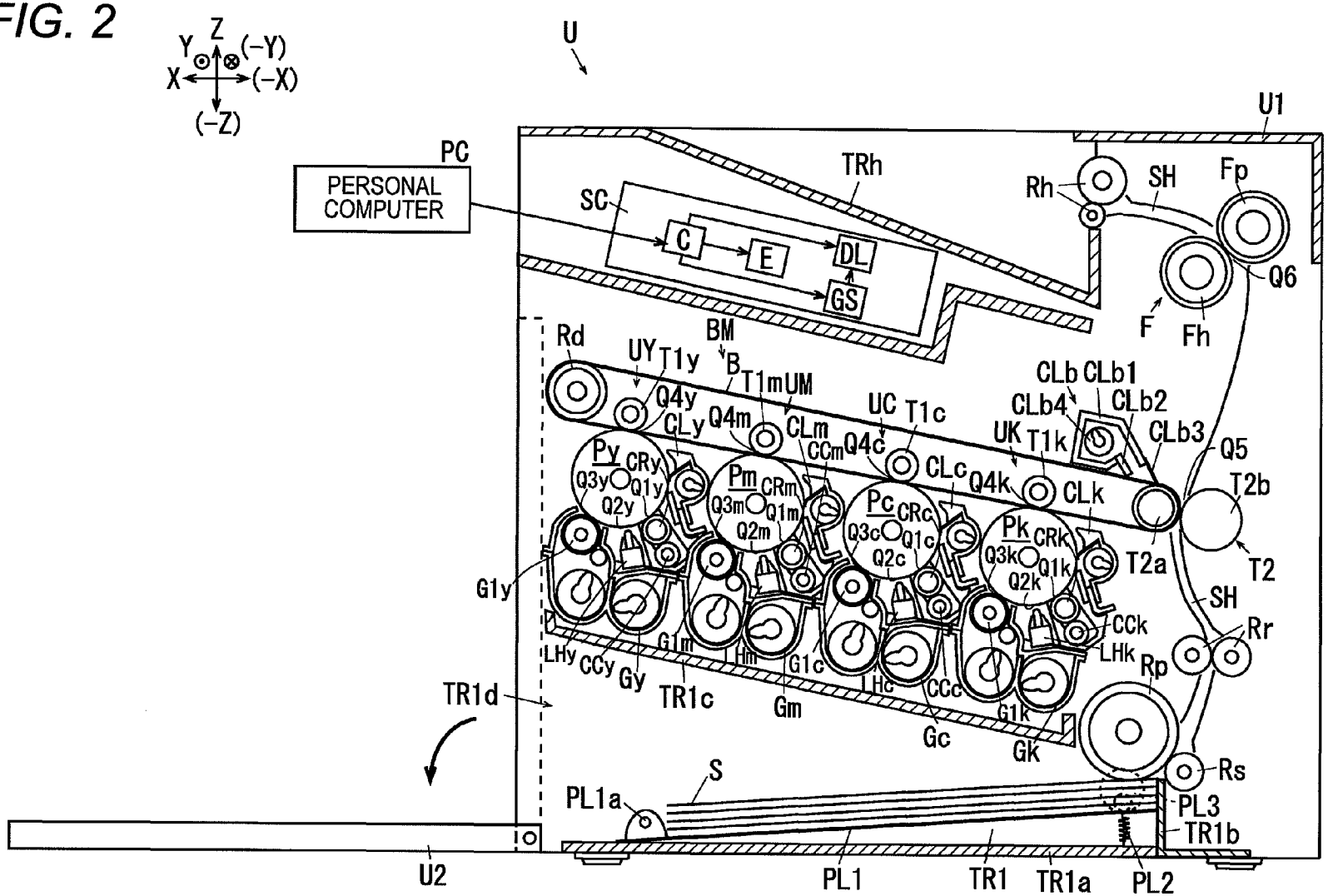
FIG. 2 is an overall explanatory view of an image forming apparatus according to the first embodiment of the invention.

FIG. 2 is an overall view for explaining the image forming apparatus according to the first embodiment of the invention.

In FIGS. 1 and 2, the front cover U2 is supported so as to be movable between an open position shown by the solid line in FIG. 2 and a closed position shown in FIGS. 1 and 2. When the front cover U2 is in the open position, paper as an example of a medium can be inserted.

In FIG. 2, in the upper portion of the printer U, a control board SC where various control circuits, storage media, etc. are arranged is disposed under the discharge tray TRh. The control board SC is provided with a control portion C, an image processing portion GS, a latent image forming unit drive circuit DL, a power supply circuit E, etc. The control portion C performs various controls on the printer U. The operations of the image processing portion GS, the latent image forming unit drive circuit DL and the power supply circuit E are controlled by the control portion C. The power supply circuit E is an example of a power supply unit. The power supply circuit E applies voltages to each charging roller CRy to CRk as an example of a charger, each developing roll G1*y* to G1*k* as an example of a developer retainer, each transfer roll T1*y* to T1*k* as an example of a transferer, etc., which will be described later.

The image processing portion GS converts print information into image information for forming latent images corresponding to images of four colors of yellow, magenta, cyan and black, that is, Y, M, C and K. The print information is inputted from a personal computer PC or the like as an example of an external information transmitting apparatus. The image processing portion GS supplies the converted image information to the latent image forming unit drive circuit DL.

When an original image is a unicolor image or a so-called monochrome image, image information of only black is supplied to the latent image forming unit drive circuit DL.

The latent image forming unit drive circuit DL has not-shown drive circuits of yellow Y, magenta M, cyan C and black K to output signals corresponding to the input image information to LED heads LHy, LHm, LHc and LHk at given times respectively. Each LED head LHy, LHm, LHc, LHk is an example of a latent image forming unit disposed for each color.

In FIG. 2, visible image forming units UY, UM, UC and UK for forming toner images as examples of visible images of the respective colors, yellow, magenta, cyan and black, are disposed in the lower central portion of the image forming apparatus body U1. In FIG. 2, the visible image forming unit UK of black, that is, the color K has a photoconductor Pk which is an example of a rotary image retainer. The charging roller CRk which is an example of a charger for charging the surface of the photoconductor Pk, the LED head LHk which is an example of a latent image forming unit for forming an electrostatic latent image on the photoconductor surface, a developing unit Gk for developing the electrostatic latent image on the photoconductor surface into a visible image, a photoconductor cleaner CLk which is an example of an image retainer cleaner for removing a developer staying on the surface of the photoconductor Pk, etc. are disposed around the photoconductor Pk.

According to the first embodiment, the magenta and cyan visible image forming units UM and UC are configured in the same manner as the black visible image forming unit UK, but the developing unit Gy of the yellow visible image forming unit UY has a different shape. The other members of the yellow visible image forming unit UY, that is, a photoconductor Py, the charging roller CRy, the LED head LHy and a photoconductor cleaner CLk are configured in the same manner. The developing units Gy to Gk will be described in detail later.

The surfaces of the photoconductors Py to Pk are charged uniformly in charging areas Q1*y*, Q1*m*, Q1*c* and Q1*k* opposed to the charging rollers CRy to CRk by the charging rollers CRy to CRk respectively. Then, latent images are written on the surfaces by the LED heads LHy to LHk in latent image forming areas Q2*y*, Q2*m*, Q2*c* and Q2*k* respectively. The written electrostatic latent images are developed into toner images in developing areas Q3*y*, Q3*m*, Q3*c* and Q3*k* opposed to the developing units Gy to Gk respectively. The developed toner images are conveyed to primary transfer areas Q4*y*, Q4*m*, Q4*c* and Q4*k* contacting with an intermediate transfer belt B which is an example of an intermediate transferer. In the primary transfer areas Q4*y*, Q4*m*, Q4*c* and Q4*k*, primary transfer voltages whose polarities are reverse to the charged polarity of the toners are applied to primary transfer rolls T1*y*, T1*m*, T1*c* and T1*k* at given times respectively by the power supply circuit E controlled by the control portion C. Each primary transfer roll T1*y*, T1*m*, T1*c*, T1*k* is an example of a primary transferer disposed on the back surface side of the intermediate transfer belt B.

According to the first embodiment, as shown in FIG. 2, in the visible image forming units UY to UK, the Y primary transfer area Q4*y* as an example of a first transfer area, the M primary transfer area Q4*m* as an example of a first transfer area, the C primary transfer area Q4*c* as an example of a first transfer area and the K primary transfer area as an example of a first transfer area are disposed on a straight line along the intermediate transfer belt B respectively.

The toner images on the photoconductors Py to Pk are primarily transferred onto the intermediate transfer belt B by the primary transfer rolls T1*y*, T1*m*, T1*c* and T1*k* respectively.

Residual or attached materials such as untransferred toners or corona products on the surfaces of the photoconductors Py, Pm, Pc and Pk after the primary transfer are cleaned up by photoconductor cleaners CLy, CLm, CLc and CLk respectively. The cleaned surfaces of the photoconductors Py, Pm, Pc and Pk are charged again by the charging rollers CRy, CRm, CRc and CRk respectively. Residual materials etc. that cannot be removed by the photoconductor cleaners CLy to CLk but adhere to the charging rollers CRy, CRm, CRc and CRk are cleaned up by charger cleaners CCy, CCm, CCc and CCk disposed in contact with the charging rollers CRy to CRk, respectively. Each charger cleaner CCy, CCm, CCc, CCk is an example of a charger cleaning member.

In FIG. 2, a belt module BM which is an example of an intermediate transfer unit is disposed above the photoconductors Py to Pk. The belt module BM includes the intermediate transfer belt B which is an example of an object to be transferred and an example of an intermediate transferer. The intermediate transfer belt B is supported rotatably by an intermediate transfer support system which is constituted by a belt driving roll Rd as an example of a driving member, a backup roll T2*a* as an example of a driven member and an example of a secondary transfer opposed member, and the primary transfer rolls T1*y*, T1*m*, T1*c* and T1*k* disposed in opposition to the photoconductors Py to Pk respectively.

A belt cleaner CLb as an example of an intermediate transferer cleaner is disposed above the rear portion of the intermediate transfer belt B. The belt cleaner CLb has a cleaning vessel CLb1, a belt cleaning blade CLb2, a film CLb3 and a residual material conveyance member CLb4. The belt cleaning blade CLb2 is an example of a cleaning member, which is supported on the cleaning vessel CLb1 and brought into contact with the intermediate transfer belt B to clean residual materials staying on the surface of the intermediate transfer belt B. The film CLb3 is an example of a leakage prevention member, which prevents the residual materials removed by the belt cleaning blade CLb2 from flying out and leaking out. The residual material conveyance member CLb4 is disposed in the cleaning vessel CLb1 to convey and discharge the removed residual materials. The cleaning vessel CLb1 according to the first embodiment is disposed in a position above the black photoconductor cleaner CLk.

A secondary transfer roll T2*b* which is an example of a secondary transfer member is disposed in opposition to the surface of the intermediate transfer belt B which is in contact with the backup roll T2*a*. A secondary transferer T2 as a final transfer unit according to the first embodiment is constituted by the backup roll T2*a* and the secondary transfer roll T2*b*. A secondary transfer area Q5 is formed by the area where the secondary transfer roll T2*b* and the intermediate transfer belt B are opposed to each other.

Unicolor or multi-color toner images transferred to overlap one another in turn on the intermediate transfer belt B in the primary transfer areas Q4*y*, Q4*m*, Q4*c* and Q4*k* by the primary transfer rolls T1*y*, T1*m*, T1*c* and T1*k* respectively are conveyed to the secondary transfer area Q5.

A transfer unit T1+T2+B according to the first embodiment, which transfers the developers on the surfaces of the photoconductors Py to Pk onto a recording sheet S as an example of a medium, is constituted by the first transfer rolls T1*y* to T1*k*, the intermediate transfer belt B and the secondary transfer unit T2.

As shown in FIG. 2, the intermediate transfer belt B according to the first embodiment is disposed so that the primary transfer areas Q1*y* to Q1*k* descend rearward with respect to the horizontal plane. Correspondingly thereto, the visible image forming units UY to UK are also disposed so that one on the downstream side in the belt rotation direction is displaced downward in the direction of gravity from another on the upstream side.

Under the visible image forming units UY to UK, a paper feed tray TR1 is provided as an example of a medium storage portion. The paper feed tray TR1 has a bottom wall TR1*a*, a rear end wall TR1*b* and an upper wall TR1*c*. The bottom wall TR1*a* is an example of a lower wall. The rear end wall TR1*b* extends upward from the rear end of the bottom wall TR1*a*. The upper wall TR1*c* is disposed above the bottom wall TR1*a* and in opposition thereto. A supply port TR1*d* for supplying new recording sheets S is formed in the front end portion of the paper feed tray TR1. The front end portion of the upper wall TR1*c* is formed to ascend frontally toward the outside of the supply port TR1*d*.

Accordingly, the distance between the upper wall TR1*c* and the bottom wall TR1*a* in the supply port TR1*d* becomes larger on the front side. Thus, the supply port TR1*d* is formed to be wider on the front side.

A lifting plate PL1 as a media loading portion is disposed on the bottom wall TR1*a*. The lifting plate PL1 is supported rotatably around a rotation center PL1*a* and loaded with the recording sheets S as an example of media so as to lift the recording sheets S. A lifting spring PL2 as an example of an urging member for urging the rear end portion of the lifting plate PL1 upward is disposed on the rear end portion of the lifting plate PL1. When image formation is not performed, the lifting plate PL1 moves to a descending position where the lifting plate PL1 is kept in parallel with the bottom wall TR1*a* by depressing members PL3 shaped like eccentric cams. The depressing members PL3 are disposed in the opposite left and right end portions of the lifting plate PL1. During image formation, the depressing members PL3 are rotated so that the lifting plate PL1 is supported movably between the descending position and an ascending position where the lifting plate PL1 has been lifted by the lifting spring PL2 as shown in FIG. 2.

When the front cover U2 is opened, the supply port TR1*d* is opened to the outside. Thus, a new sheaf of recording sheets S can be inserted to abut against the rear end wall TR1*b* so as to be loaded and received on the lifting plate PL1 in the descending position.

A paper feed roll Rp as an example of a feeding-out member is disposed at the rear of the upper wall TR1*c*. The paper feed roll Rp is disposed in a position where the uppermost recording sheet S of the sheaf of the loaded recording sheets S can be pushed against the paper feed roll Rp by the spring force of the lifting spring PL2 in the state where the lifting plate PL1 has moved to the ascending position. A retard roll Rs as an example of a separation member is disposed above the rear end wall TR1*b*.

The recording sheets S loaded on the paper feed tray TR1 are fed out by the paper feed roll Rp, and separated one by one in the area where the retard roll Rs and the paper feed roll Rp are in contact with each other. Each separated recording sheet S is conveyed to a medium conveyance path SH. The recording sheet S in the medium conveyance path SH is conveyed to registration rolls Rr which are examples of paper feed timing adjustment members. The recording sheet S conveyed to the registration rolls Rr is fed out to the secondary transfer area Q5 in sync with the timing when the toner images on the intermediate transfer belt B reach the secondary transfer area Q5.

From the intermediate transfer belt B where the toner images have been transferred in the secondary transfer area Q5, residual materials such as untransferred toners or corona products staying on the surface of the intermediate transfer belt B are removed and cleaned by the belt cleaner CLb.

The recording sheet S to which the toner images have been transferred is conveyed to a fixing area Q6 of a fixing unit F. The fixing unit F has a heating roll Fh as a heating fixing member and a pressure roll Fp as an example of a pressure fixing member. The fixing area Q6 consists of an area where the heating roll Fh and the pressure roll Fp are in contact with each other with a predetermined pressure. The unfixed toner images on the surface of the recording sheet S are fixed by heat and pressure when the toner images pass through the fixing area Q6.

The recording sheet S where the images have been fixed is conveyed in the medium conveyance path SH, and discharged to the discharge tray TRh through discharge rollers Rh which are examples of medium discharge members.

Figure 3:
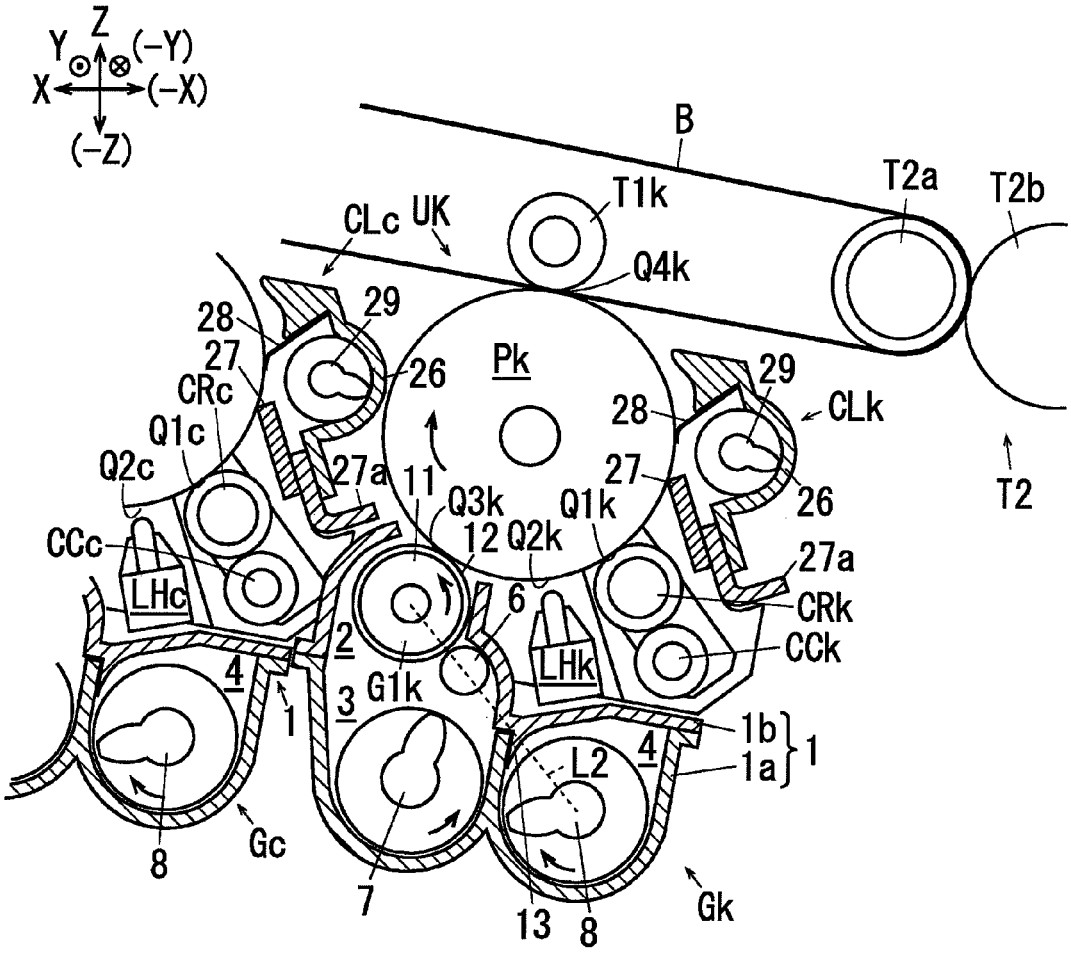
FIG. 3 is a main portion enlarged explanatory view of a visible image forming unit according to the first embodiment of the invention.

FIG. 3 is a main portion enlarged explanatory view of a visible image forming unit according to the first embodiment of the invention.

Figure 4:
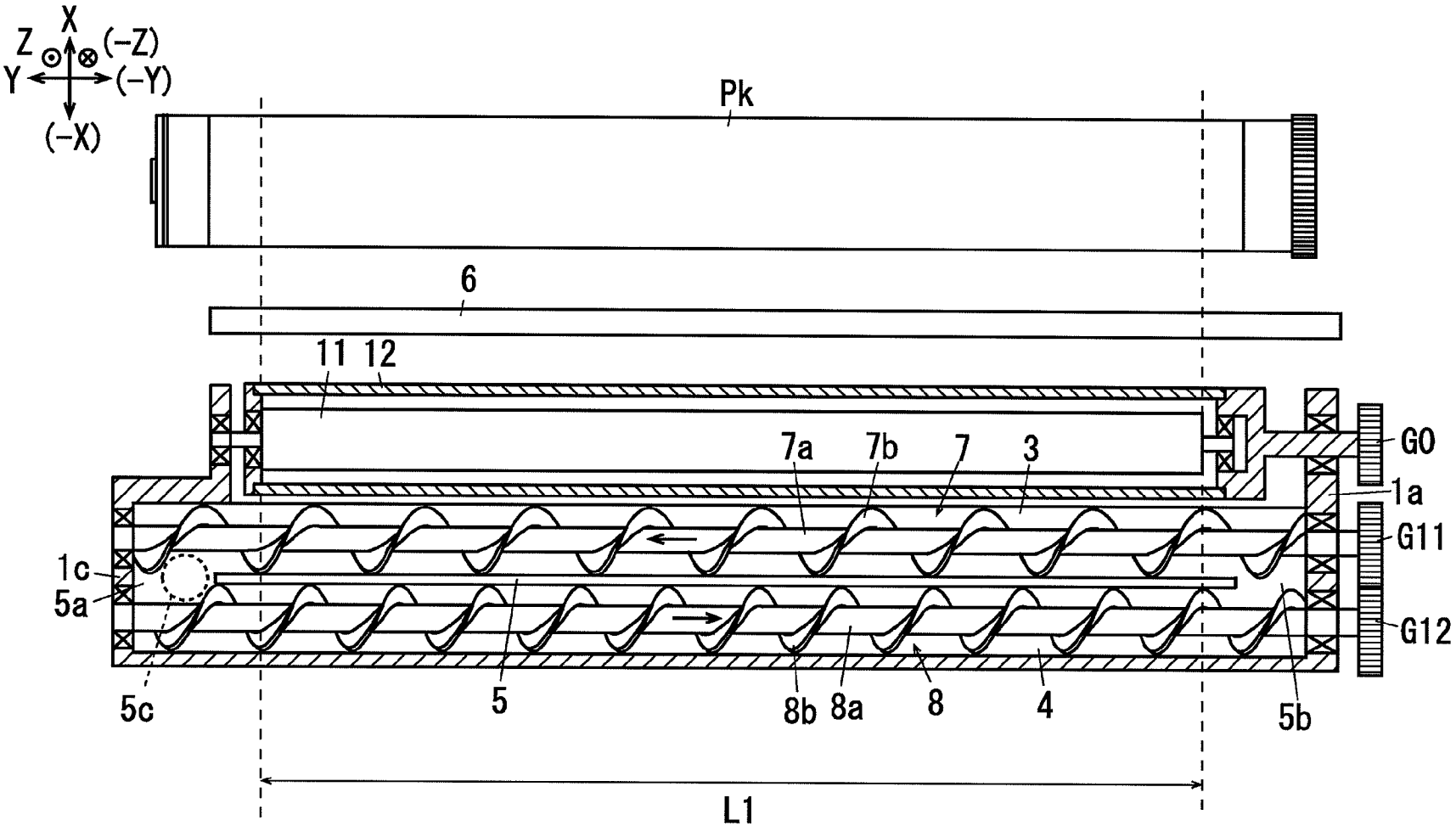
FIG. 4 is a view for explaining a positional relationship among a developing vessel, a layer thickness limiting member and a developing roll according to the first embodiment.

FIG. 4 is a view for explaining the positional relationship among a developing vessel, a layer thickness limiting member and a developing roll according to the first embodiment.

Next, the developing units according to the first embodiment will be described. The developing units Gy to Gk for the respective colors Y, M, C and K are constituted in the same manner. Therefore, only the black visible image forming unit UK will be described, while detailed description about the other yellow, magenta and cyan developing units Gy to Gc will be omitted.

In FIG. 3, the black developing unit Gk according to the first embodiment is disposed under the photoconductor Pk. The developing unit Gk has a second developing vessel 1 for receiving a developer internally. The developing vessel 1 has a lower vessel body 1*a* and a cover member 1*b* for covering the top of the vessel body 1*a*. In the developing vessel 1 according to the first embodiment, the cover member 1*b* is made of a magnetic material.

A developing roll chamber 2 as an example of a retainer receiving portion, a supply chamber 3 as an example of a first agitation portion and an agitation chamber 4 as an example of a second agitation portion are provided inside the developing vessel 1. The developing roll G1*k* as an example of a developer retainer is received in the developing roll chamber 2. The supply chamber 3 is formed to be adjacent to and continuous with the bottom of the developing roll chamber 2. The agitation chamber 4 is formed to be adjacent to the rear of the supply chamber 3.

In FIG. 3, in the developing vessel 1 according to the first embodiment, the agitation chamber 4 is disposed on a lower level than the supply chamber 3 in the direction of gravity.

The supply chamber 3 and the agitation chamber 4 are partitioned by a partition 5 which is an example of a partition member extending in the left/right direction. In addition, a right inlet portion 5*a* as an example of a first connection portion and a left inlet portion 5*b* as an example of a second connection portion are formed in the opposite left and right end portions of the partition 5 so that a developer can flow between the supply chamber 3 and the agitation chamber 4.

The inlet portions 5*a* and 5*b* are formed correspondingly to the outside of an image forming area L1 where an image will be formed on the photoconductor Pk. Thus, a developer flowing in and out through the inlet portions 5*a* and 5*b* is restrained from having an adverse effect on image formation.

The image forming area L1 is an example of a retaining area where an image will be retained by the image retainer.

In the developing unit Gk according to the first embodiment, a supply port 5*c* is disposed in the right inlet portion 5*a*. The supply port 5*c* is an example of a supply portion, through which a new developer is supplied from above.

In FIGS. 3 and 4, the developing roll G1*k* has a columnar magnet roll 11 as an example of a magnet member, which is fixedly supported on the developing vessel 1. According to the first embodiment, the axial length of the magnet roll 11 is set to correspond to the length of the image forming area L1. A cylindrical developing sleeve 12 surrounding the magnet roll 11 is supported rotatably on the outer circumference of the magnet roll 11. The developing sleeve 12 is an example of a retaining member. A gear G0 as an example of a gear is fixedly supported on the left end of the developing sleeve 12. A driving force is transmitted from a not-shown developing unit motor to the gear G0 so as to rotate the developing sleeve 12. The developing unit motor is an example of a developing drive source. The rotation direction of the developing roll G1*k* according to the first embodiment is set to be reverse to that of the photoconductor Pk. That is, in FIG. 3, the developing roll G1*k* rotates counterclockwise in a reverse direction to that of the photoconductor Pk which rotates clockwise. Accordingly, in the developing area Q3*k*, the surface of the photoconductor Pk rotates in the same direction as the surface of the developing roll G1*k*.

A trimmer 6 which is an example of a magnet member and an example of a layer thickness limiting member is supported in the developing roll chamber 2 and disposed on the upstream side of the developing area Q3*k* in the rotation direction of the developing roll G1*k*. The trimmer 6 is disposed at a predetermined distance from the developing sleeve 12 and in opposition to the developing sleeve 12 so as to limit the layer thickness of a developer layer retained on the surface of the developing roll G1*k*. The trimmer 6 according to the first embodiment is constituted by a columnar rod-like member made of a magnetic material. In addition, the left/right-direction length of the trimmer 6 is set to be as long as the inside distance between the right inlet portion 5*a* and the left inlet portion 5*b*, and to be longer than the length L1 of the magnet roll 11.

In FIGS. 3 and 4, a supply auger 7 as an example of a first agitation member extending in the left/right direction is rotatably supported in the supply chamber 3. The supply auger 7 has a supply shaft 7*a* as an example of a first rotary shaft, which extends in the supply chamber 3 in the left/right direction. A supply spiral 7*b* as an example of a first conveyance blade is supported on the outer circumference of the supply shaft 7*a*. A gear G11 as an example of a gear is fixedly supported on the right end of the supply shaft 7*a*. In FIGS. 3 and 4, according to the first embodiment, the rotation direction of the supply auger 7 is set so that when a driving force is transmitted to the supply auger 7 from a not-shown drive source so as to rotate the supply auger 7, the developer in the supply chamber 3 is conveyed from left to right in a first conveyance direction by the supply spiral 7*b* so as to flow into the agitation chamber 4 through the right inlet portion 5*a*.

An admix auger 8 as an example of a second agitation member extending in the left/right direction and in parallel with the supply auger 7 is rotatably supported in the agitation chamber 4. The admix auger 8 has an admix shaft 8*a* as a second rotary shaft, which extends in the left/right direction. An admix spiral 8*b* as an example of a second conveyance blade is supported on the outer circumference of the admix shaft 8*a*. A gear G12 as an example of a gear is fixedly supported on the right end of the admix shaft 8*a*. The gear G12 engages with the gar G11 of the supply auger 7. In FIG. 4, according to the first embodiment, the rotation direction of the admix auger 8 is set so that when a driving force is transmitted to the admix auger 8 so as to rotate the admix auger 8, the developer in the agitation chamber 4 is conveyed from right to left in a second conveyance direction reverse to that of the supply auger 7 so as to flow into the supply chamber 3 through the left inlet portion 5*b*. As a result, the developer is circulated and conveyed while being agitated through a circulating chamber 3+4 consisting of the supply chamber 3 and the agitation chamber 4.

Further, in FIG. 3, the rotation direction of the admix auger 8 according to the first embodiment is set so that the admix auger 8 can rotate from below to above in the direction of gravity in the supply auger side of the admix shaft 8*a* in a section perpendicular to the admix shaft 8*a* shown in FIG. 3. Accordingly, a force to lift the developer from the lower agitation chamber 4 toward the upper supply chamber 3 acts on the developer in the left inlet portion 5*b* due to the rotating admix spiral 8*b* so as to urge the developer to flow into the upper supply chamber 3.

Figure 5:
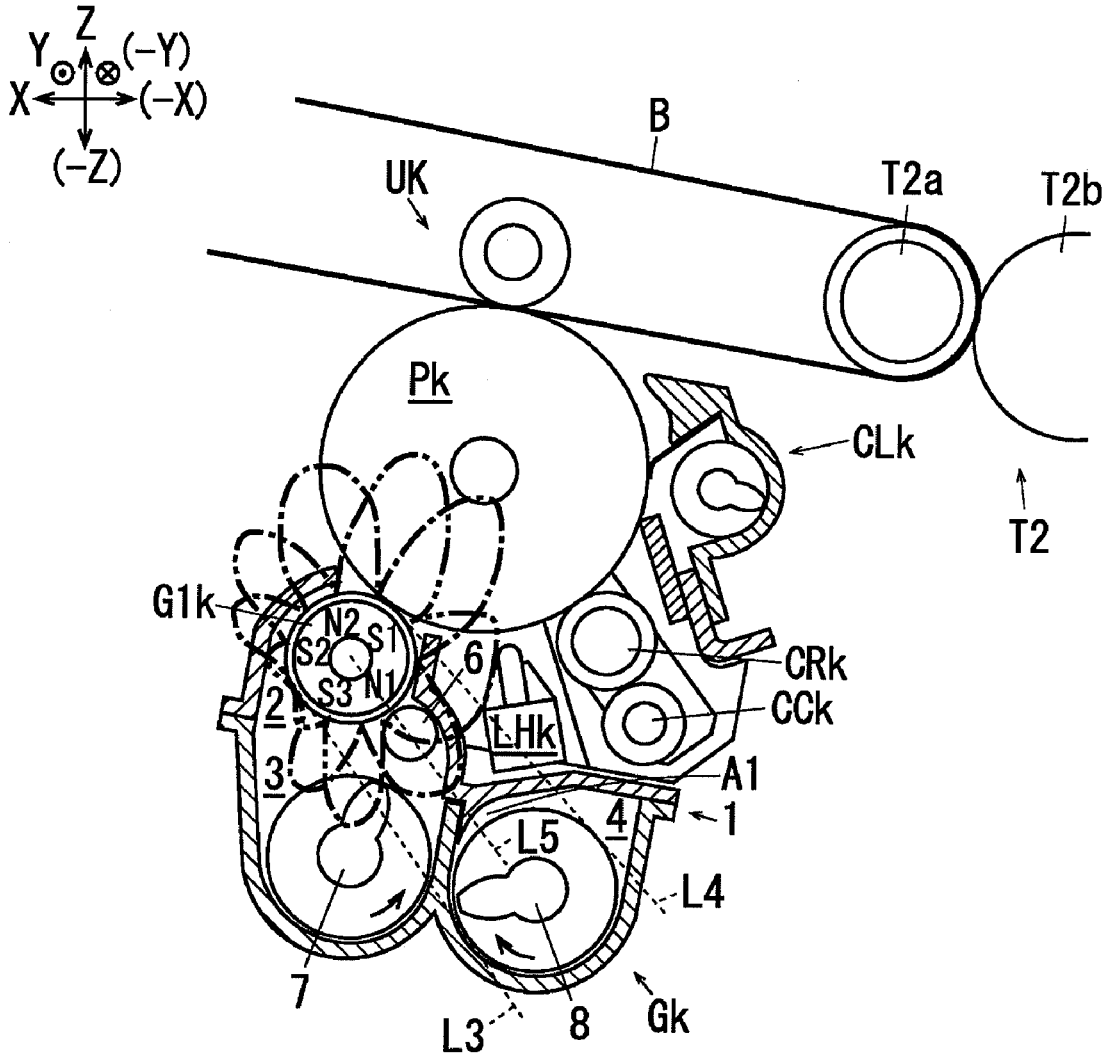
FIG. 5 is a view for explaining magnetic poles of a developing unit according to the first embodiment.

FIG. 5 is a view for explaining magnetic poles of each developing unit according to the first embodiment.

In FIG. 5, in the developing unit Gk according to the first embodiment, the magnet roll 11 has a developing magnetic pole S1 disposed correspondingly to the developing area Q3*k*. A trimming magnetic pole N1 as an example of a layer thickness limiting magnetic pole for radially arranging or erecting particles of the developer is disposed in opposition to the trimmer 6 and on the upstream side of the developing magnetic pole S1 in the rotation direction of the developing sleeve 12. A conveyance magnetic pole N2 for retaining the developer on the developing sleeve 12 is disposed on the downstream side of the developing magnetic pole S1 in the rotation direction of the developing sleeve 12. A pickoff magnetic pole S2 as an example of a separation magnetic pole for separating the developer from the developing sleeve 12 and a pickup magnetic pole S3 as an example of a suction magnetic pole for sucking the developer in the supply chamber 3 onto the developing sleeve 12 are disposed on the downstream side of the conveyance magnetic pole N2. As shown in FIG. 5, the magnetic field generated by the respective magnetic poles according to the first embodiment is set so that the intensity of the magnetic poles in the normal direction of the developing sleeve 12 has a distribution expressed by the chain single-dash lines and the intensity of the magnetic poles in the tangent direction along the circumferential direction of the developing sleeve 12 has a distribution expressed by the chain double-dash lines.

Thus, the trimmer 6 made of a magnetic material according to the first embodiment is disposed between the developing roll G1*k* and the admix auger 8. In addition, a front end portion of a top wall portion 13 of the cover member 1*b* made of a magnetic material and constituting the top of the agitation chamber 4 is also disposed between the developing roll G1*k* and the admix auger 8. Accordingly, the cover member 1*b* has a function as a wall surface forming member in the first embodiment.

Thus, in the developing unit Gk according to the first embodiment, the trimmer 6 and the top wall portion 13 are at least partially disposed on a straight line L5 connecting the position of the trimming magnetic pole N1 where the normal magnetic force of the magnetic pole is maximal and the rotation center of the developing roll G1*k*.

Particularly in the first embodiment, the trimmer 6 and the top wall portion 13 are received in an area surrounded by common tangents L3 and L4 of the developing roll G1*k* and the circumscribed circle of the admix auger as shown by the broken lines in FIG. 5.

In the printer U configured thus according to the first embodiment of the invention, the developer circulated in the circulating chamber 3+4 of each developing unit Gy to Gk is attracted by the magnetic force of the magnet roll 11 of the developing roll G1*y* to G1*k* in the supply chamber 3, sucked and retained on the surface of the developing sleeve 12 and used for development.

Here, in the developing unit Gy to Gk according to the first embodiment, the trimming magnetic pole N1 is disposed correspondingly to the trimmer 6, while the agitation chamber 4 and the admix auger 8 are disposed on an extended line L2 connecting the developing roll G1*y* to G1*k* and the trimmer 6.

In the configuration of the developing unit Gy to Gk according to the first embodiment, the developing vessel 1 is miniaturized so that the distance between the developing roll G1*y* to G1*k* and the admix auger 8 becomes short. If the trimmer 6 or the top wall portion 13 were not made of a magnetic material, there is a possibility that the magnetic force of the trimming magnetic pole N1 would reach the agitation chamber 4 so that the developer might be sucked in an area A1 which is an inside portion of the top wall portion 13 of the agitation chamber 4. The developer would be sucked and become lumps and the developer would stay so that conveyance of the developer in the agitation chamber 4 would be unstable. In addition, if the developer stayed long, there is a possibility that the charge amount of the staying developer might be lowered due to electric discharging to produce a difference from the charge amount of the developer being agitated and conveyed, so that the image quality might deteriorate due to density unevenness caused by poor development or the like.

On the other hand, according to the first embodiment, the trimmer 6 and the top wall portion 13 are made of magnetic materials. The lines of magnetic force are disturbed in the agitation chamber 4 rather than in the trimmer 6 so that the magnetic force is lowered in the agitation chamber 4, in comparison with the case where the trimmer 6 and the top wall portion 13 are made of nonmagnetic materials. Accordingly, in each developing unit Gy to Gk according to the first embodiment, the magnetic force in the area A1 is reduced so that bad conveyance of the developer due to the suction of the developer can be suppressed, and poor development can be also reduced.

Particularly in the configuration of the first embodiment, the admix auger 8 rotates to lift the developer from the agitation chamber 4 toward the supply chamber 3. Thus, in the agitation chamber 4, the developer is apt to lean to the inside of the front end of the top wall portion 13, that is, toward the supply chamber 3. The developer leaning thus is apt to be sucked. In other words, the developer is sucked conspicuously when the trimmer 6 or the top wall portion 13 is made of a nonmagnetic material. However, according to the first embodiment, the suction of the developer can be reduced due to the trimmer 6 or the top wall portion 13. Thus, the developer can be conveyed smoothly from the lower agitation chamber 4 toward the upper supply chamber 3, while bad conveyance can be reduced.

In addition, in the configuration according to the first embodiment, the admix auger 8 is disposed to be slightly lower than the supply auger 7 with respect to the up/down direction or the direction of gravity. That is, the admix auger 8 is kept at a longer distance from the magnet roll 11 than in the configuration where the admix auger 8 is disposed on a level as high as the supply auger 7 with respect to the up/down direction or the direction of gravity. Thus, the distance is secured so that the admix auger 8 can be further prevented from being affected by the magnetic force of the magnet roll 11.

Further, the trimmer 6 made of a magnetic material according to the first embodiment may be magnetized due to the magnetic force of the trimming magnetic pole N1. If the end portions of the trimmer 6 with the developer adhering to the trimmer 6 approached the inlet portions 5*a* and 5*b*, there is a possibility that the flow of the developer in the inlet portions 5*a* and 5*b* might be disturbed by the sucked developer. However, the trimmer 6 according to the first embodiment is set to be as long as the inside distance between the right inlet portion 5*a* and the left inlet portion 5*b*. Therefore, the end portions of the trimmer 6 do no overlap the inlet portions 5*a* and 5*b*, but bad conveyance of the developer can be suppressed.

Figure 6:
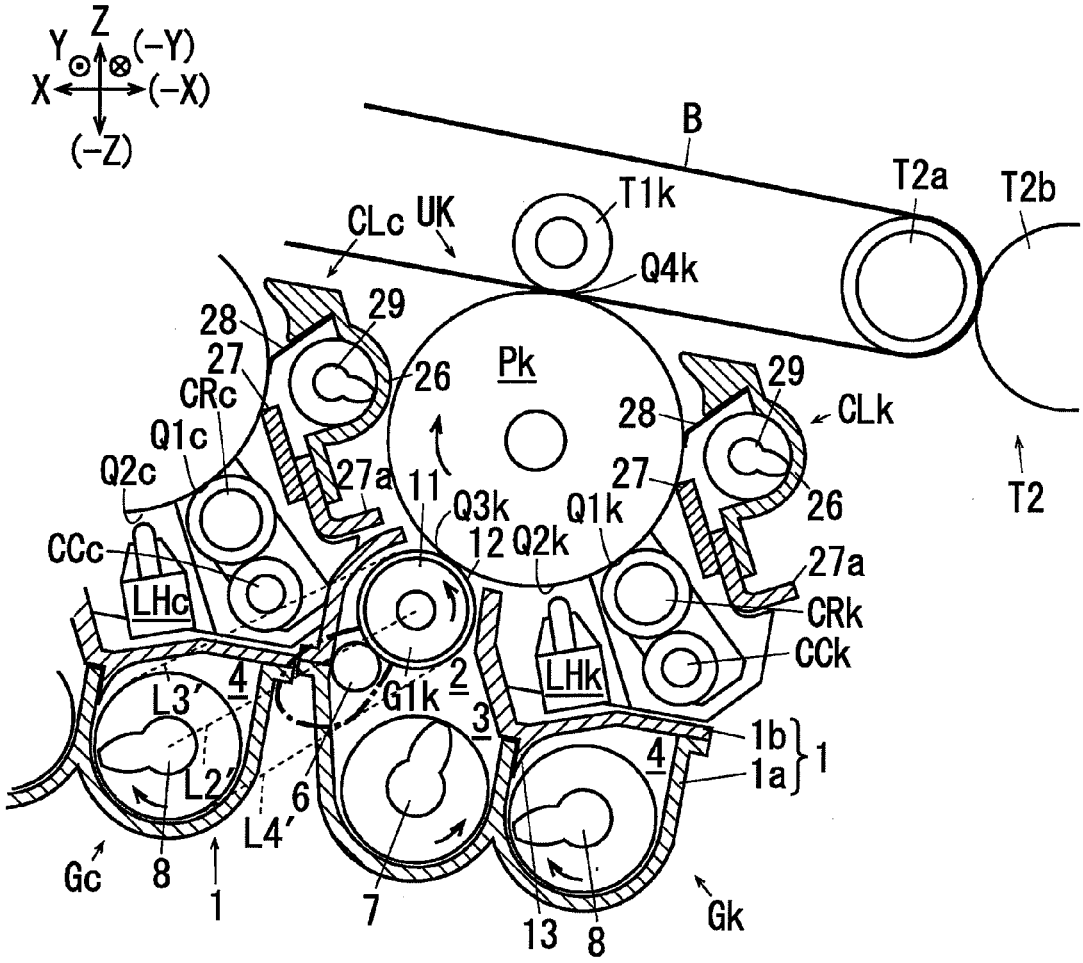
FIG. 6 is a view for explaining a developing unit according to a second embodiment and a view corresponding to FIG. 5 of the first embodiment.

FIG. 6 is a view for explaining each developing unit according to a second embodiment and a view corresponding to FIG. 5 showing the first embodiment.

Next, the second embodiment of the invention will be described. In description of the second embodiment, constituent members corresponding to those in the first embodiment are referred to by the same numerals, and detailed description thereof will be omitted.

The embodiment has the same configuration as the first embodiment in all points except the following points.

In FIG. 6, unlike the first embodiment, in each developing unit Gy to Gk according to the second embodiment, the rotation direction of the developing sleeve 12 of the developing roll G1*y* to G1*k* is set in a reverse direction so that developing sleeve 12 rotates in a reverse direction to that of the photoconductor Py to Pk in the developing area Q3*y* to Q3*k*. In accordance with the change of the rotation direction of the developing sleeve 12, the trimmer 6 is disposed in the front lower on the upstream side of the developing area Q3*y* to Q3*k* along the rotation direction of the developing sleeve 12.

In a magnet roll 11' according to the second embodiment, the positions of the magnetic poles N1, N2 and S1-S3 are also changed in accordance with the change of the position of the trimmer 6. The trimming magnetic pole N1 is set so that the maximum position of the magnetic force in the normal direction corresponds to the trimmer 6.

Accordingly, the trimmer 6 made of a magnetic material according to the second embodiment is disposed between the developing roll G1*m* to G1*k* of the M, C, K developing unit Gm to Gk serving as a first developing unit and the admix auger 8 of the Y, M, C developing unit Gy to Gc serving as a second developing unit disposed adjacently to the aforementioned developing unit Gm to Gk. And as show in FIG. 6, at least a part of the trimmer 6 is disposed on a straight line L2' connecting the position of the trimming magnetic pole N1 where the normal magnetic force of the magnetic pole becomes maximal and the rotation center of the developing roll G1*k*.

In addition, according to the second embodiment, the trimmer 6 is received in the area surrounded by common tangents L3' and L4' of the developing roll G1*m* to G1*k* and the circumscribed circle of the admix auger 8 of the adjacent developing unit Gy to Gc as shown by the broken lines in FIG. 6. The trimmers 6 of Gc, Gm are respectively disposed in a similar way to the trimmer 6 of Gk.

There is a possibility that the magnetic force generated by the trimming magnetic pole N1 would act on the adjacent developing unit Gy to Gc so that the developer might be sucked in the adjacent agitation chamber 4 to cause bad conveyance. However, in the printer U configured thus according to the second embodiment, the trimmer 6 as a magnetic member is disposed between the developing roll G1*m* to G1*k* and the admix auger 8 of the adjacent developing unit Gy to Gc so as to reduce bad conveyance inside the adjacent agitation chamber. Accordingly, the developing units Gy to Gk can be disposed closely to each other while bad conveyance inside each developing vessel 1 can be reduced. Thus, the printer U as a whole can be miniaturized.

The embodiments of the invention have been described above in detail. The invention is not limited to the embodiments, but various modifications can be made thereon within the scope of the invention stated in the appending claims. Modifications (H01) to (H07) of the invention will be described below by way of example.

(H01) In each of the aforementioned embodiments, the printer U is constituted by a so-called printer. The invention is not limited to the printer but can be constituted by a copying machine, a facsimile machine, or a composite machine with a plurality of or all of those functions of the facsimile machine and the copying machine.

(H02) In each of the aforementioned embodiments, the printer U is not limited to a configuration where toners of four colors are used, but may be applied to a configuration where toners of five or more colors or toners of two or three colors are used.

(H03) In the first embodiment, it is desired that the relationship in height in the direction of gravity between the supply chamber 3 and the agitation chamber 4, the inclination of the intermediate transfer belt B, the rotation directions of each developing roll G1*y* to G1*k*, the supply auger 7 and the admix auger 8, etc. are set in the illustrated manner. However, the invention is not limited to the illustrated configuration, but may be changed suitably in accordance with design, specifications or the like.

(H04) In the first embodiment, it is desired to make both the trimmer 6 and the cover member 1*b* from magnetic materials. However, either the trimmer 6 or the cover member 1*b* may be made from a magnetic material. Also in this case, bad conveyance can be reduced in comparison with the case where both are made from nonmagnetic materials.

(H05) In each of the aforementioned embodiments, the trimmer 6 is formed to have a shape like a round bar member. However, the invention is not limited to such a configuration, but the trimmer 6 may be formed into any shape such as a plate-like shape.

(H06) In each of the aforementioned embodiments, the whole of the cover member 1*b* is made from a magnetic material. However, the invention is not limited to the configuration. For example, configuration may be made so that only the top wall portion 13 is made from a magnetic material, or the cover member may be made from a nonmagnetic material such as resin while a plate or the like made from a magnetic material is pasted onto the wall surface of the cover member.

(H07) Each of the aforementioned embodiments shows the configuration where the magnet roll 11 is fixed and the developing sleeve 12 rotates. The invention is not limited to the configuration. For example, it is possible to use a developing roll known in the background art, such as a developing roll with a magnet roll 11 rotating to convey a developer.

What is claimed is:

1. A developing unit comprising:

a developer retainer that includes a magnet member and a retaining member, the magnet member having magnetic poles, the retaining member being provided on an outer circumference of the magnet member and retaining a developer having magnetism to be attracted on a surface of the retaining member by a magnetic force of the magnet member;

a developing vessel that receives the developer internally, and that includes a retainer receiving portion, a first agitation portion and a second agitation portion, the retainer receiving portion receiving the developer retainer, the first agitation portion being adjacent to the retainer receiving portion, the second agitation portion being adjacent to the first agitation portion;

a first conveyance member that is received in the first agitation portion and that conveys the developer in the first agitation portion in a first conveyance direction;

a second conveyance member that is received in the second agitation portion and that conveys the developer in the second agitation portion in a second conveyance direction which is reverse to the first conveyance direction; and a magnetic member that is disposed between the second conveyance member and the developer retainer and that has magnetism, wherein the magnetic member includes a wall surface forming member which forms a wall surface of the second agitation portion.

2. The developing unit according to claim 1, wherein:

the magnetic member includes a layer thickness limiting member which is disposed in opposition to the developer retainer and which limits a layer thickness of the developer retained on a surface of the retaining member.

3. The developing unit according claim 1, wherein:

the wall surface forming member is formed out of a cover member which forms a top surface of the second agitation portion.

4. The developing unit according to claim 1, wherein:

at least a part of the magnetic member is disposed on a straight line connecting a position of a magnetic pole of the magnet member in which a normal magnetic force becomes maximal and a rotation center of the developer retainer.

5. The developing unit according to claim 1, further comprising:

a partition member that partitions the first agitation portion and the second agitation portion;

a first connection portion that connects a downstream end of the first agitation portion in the first conveyance direction and an upstream end of the second agitation portion in the second conveyance direction; and a second connection portion that connects an upstream end of the first agitation portion in the first conveyance direction and a downstream end of the second agitation portion in the second conveyance direction, wherein the first and second connection portions are disposed axially outside axial end portions of the magnet member respectively.

6. The developing unit according to claim 1, wherein:

the second agitation portion is disposed on a lower level in a direction of gravity than the first agitation portion; and the second conveyance member rotates from below to above in the direction of gravity in a first-agitation-member-side area of the second conveyance member in a direction perpendicular to a rotary shaft of the second conveyance member.

7. An image forming apparatus comprising:

an image retainer of which a latent image is formed on a surface;

the developing unit according to claim 1, which is disposed in opposition to the image retainer and which develops the latent image on the surface of the image retainer into a visible image;

a transfer unit that transfers the visible image on the surface of the image retainer to a surface of a medium; and a fixing unit that fixes the visible image on the surface of the medium.

8. An image forming apparatus comprising:

an image retainer of which a latent image is formed on a surface;

a transfer unit that transfers the visible image on the surface of the image retainer to a surface of a medium;

a fixing unit that fixes the visible image on the surface of the medium;

a first developing unit that is disposed in opposition to the image retainer and that develops the latent image on the surface of the image retainer into a visible image; and a second developing unit that is disposed adjacently to the first developing unit, wherein the first and the second developing units each includes:

a developer retainer includes a magnet member and a retaining member, the magnet member having magnetic poles, the retaining member being provided on an outer circumference of the magnet member and retaining a developer having magnetism to be attracted on a surface of the retaining member by a magnetic force of the magnet member;

a developing vessel receives the developer internally, and which includes a retainer receiving portion, a first agitation portion and a second agitation portion, the retainer receiving portion receiving the developer retainer, the first agitation portion being adjacent to the retainer receiving portion, the second agitation portion being adjacent to the first agitation portion;

a first conveyance member is received in the first agitation portion and that conveys the developer in the first agitation portion in a first conveyance direction; and a second conveyance member is received in the second agitation portion and that conveys the developer in the second agitation portion in a second conveyance direction which is reverse to the first conveyance direction, wherein the first developing unit includes a magnetic member, and the magnetic member is disposed between the developer retainer of the first developing unit and the second conveyance member of the second developing unit, wherein the magnetic member includes a wall surface forming member which forms a wall surface of the second agitation portion.

9. The image forming apparatus according to claim 8, wherein the magnetic member includes a layer thickness limiting member which is disposed in opposition to the developer retainer and which limits a layer thickness of the developer retained on a surface of the retaining member.

* * * * *